US005366837A

United States Patent [19]

Sakai

[11] Patent Number: 5,366,837

[45] Date of Patent: Nov. 22, 1994

[54] IMAGE RECEIVING SHEET AND IMAGE TRANSFERRING METHOD EMPLOYING THE IMAGE RECEIVING SHEET

[75] Inventor: Jun Sakai, Nagoya, Japan

[73] Assignee: Brother Kogyo Kabushiki Kaisha, Aichi, Japan

[21] Appl. No.: 911,978

[22] Filed: Jul. 10, 1992

[30] Foreign Application Priority Data

Jul. 12, 1991 [JP] Japan ..... 3-172323
Aug. 9, 1991 [JP] Japan ..... 3-200461

[51] Int. Cl.[5] ..... G03G 13/06

[52] U.S. Cl. ..... 430/97; 430/99; 430/126; 430/138; 430/204; 430/252

[58] Field of Search ..... 430/138, 204, 97, 99, 430/126, 252

[56] References Cited

U.S. PATENT DOCUMENTS 5,104,767 3/1992 Nakamura ..... 430/138

OTHER PUBLICATIONS

Japanese Unexamined Patent Application Publication No. 61-275742 and its English Abstract.

Japanese Unexamined Patent Application Publication No. 62-39844 and its English Abstract.

*Primary Examiner*—John Kight, III
*Assistant Examiner*—Richard Lee Jones
*Attorney, Agent, or Firm*—Kane, Dalsimer, Sullivan, Kurucz, Levy, Eisele and Richard

[57] ABSTRACT

An image receiving sheet of the present invention for receiving a desired image thereon includes a support layer and an absorbing layer containing heat-meltable or thermoplastic particles. A desired image can be formed in the absorbing layer of the image receiving sheet. Through heating the image receiving sheet formed with the desired image, the heat-meltable or thermoplastic particles are thermally melted or softened to attain a glossy and transparent surface formed with the desired image. As a result, an image bearing product coated with a glossy and transparent surface formed with the desired image is obtained. Through thermally pressing the image receiving sheet formed with the visible image toward an article of arbitrary type, on the other hand, the heat-meltable or thermoplastic particles are thermally melted or softened to be adhered to a surface of the article, so that the desired image is transferred onto the surface of the article.

10 Claims, 2 Drawing Sheets

IMAGE RECEIVING SHEET AND IMAGE TRANSFERRING METHOD EMPLOYING THE IMAGE RECEIVING SHEET

BACKGROUND OF THE INVENTION

1. Field of the Invention

The present invention relates to an image receiving sheet for receiving an image thereon and an image transferring method for transferring an image onto the image receiving sheet and for retransferring the image thus transferred on the image receiving sheet onto an image receiving medium of an arbitrary type such as cloth, fabric, plain paper, wood plate, plastic films, etc.

2. Description of Related Art

Japanese Unexamined Patent Application Publication No. 61-275742 discloses a conventional photosensitive image recording medium of a type which includes a base sheet and a microcapsule layer formed of a plurality of microcapsules each encapsulating therein silver halide, reducing agent, polymerizable compound, and color-forming material. The photosensitive image recording medium is selectively exposed to light, so that the microcapsules exposed to the light are started to be hardened, but those which are not exposed to the light remain unhardened. Thereafter, the photosensitive image recording medium is entirely uniformly heated, so that the hardening action of the microcapsules which have been exposed to the light is promoted. As a result, the microcapsules positioned at areas of the microcapsule layer exposed to the light are hardened, while those positioned at areas of the microcapsule layer which are not exposed to the light remain unhardened. (The light-unexposed areas will be referred to as "image areas", hereinafter.) In other words, the photosensitive image recording medium is exposed to an imaging light and is then uniformly heated, so that a latent image is formed in the microcapsule layer. The photosensitive image recording medium and an image receiving sheet are then introduced in a pressing device in such a manner that the photosensitive image recording medium is superposed on the image receiving sheet, with the microcapsule layer being contacted face to face with a surface of the image receiving sheet. The photosensitive image recording medium and the image receiving sheet are then pressed toward each other, so that the unhardened microcapsules positioned at the image areas are ruptured. The materials encapsulated in the microcapsules flow out of the ruptured microcapsules and are transferred onto the image receiving sheet. In other words, the materials encapsulated in the microcapsules positioned at the image areas of the microcapsule layer are transferred onto the image receiving sheet. Since the materials encapsulated in the microcapsules include the color-forming material which may present or develop color, a visible image corresponding to the latent image formed on the photosensitive image recording medium is transferred or formed on the image receiving sheet and is fixed thereto. The above-described conventional image transferring method is therefore capable of performing a high-sensitive image recording operation of dry type for recording a desired image on the image receiving sheet.

In the above-described conventional image transferring method, in order to prevent the visible image thus transferred on the image receiving sheet from being blurred, it is necessary to allow the color-forming materials encapsulated in the microcapsules positioned in each image area of the photosensitive image recording medium to be transferred only onto an area of the image receiving sheet corresponding to the each image area of the photosensitive image recording medium. More specifically to say, it is necessary to prevent the color-forming materials transferred on the image receiving sheet from spreading out of the areas of the image receiving sheet corresponding to the image areas of the photosensitive recording medium. In the conventional image transferring method, therefore, the image receiving sheet includes a support layer and a porous absorbing layer provided thereon. The porous absorbing layer serves to absorb the material (color-forming material, etc.) flown out of the ruptured microcapsules to retain them therein and serves to prevent the color-forming material from being spread over an undesired area onto which the colors should not be transferred. The porous absorbing layer is formed of particles of inorganic white color pigment such as zinc oxide, titanium oxide, zeolite, talc, clay or the like and binder such as polyvinyl alcohol, polyvinyl pyrrolidone, polyvinyl acetal or the like.

Since the porous absorbing layer includes the inorganic pigment as described above, light radiated on the porous absorbing layer is liable to be scattered or reflected thereat. Accordingly, the image receiving sheet thus coated with the porous absorbing layer has such a problem that it fails to attain a glossy and transparent surface.

The above-described conventional image transferring method further has a following problem. With the image transferring method, though it is possible to transfer the image formed on the photosensitive image recording medium onto the image receiving sheet, it is impossible to transfer the image onto an article of an arbitrary type having an arbitrary shape or size. For example, it is impossible to transfer the image onto a cloth having a too large size to be introduced into the pressing device.

SUMMARY OF THE INVENTION

The present invention is achieved to solve the above-described defects. A first object of the present invention is therefore to provide an image receiving sheet which can effectively absorb the materials flown out of the ruptured microcapsules of the photosensitive image recording medium to retain the materials therein and which can attain a high glossy and improved transparent surface. A second object of the present invention is to provide an image transferring method for transferring a desired image formed on the photosensitive image recording medium onto an article of arbitrary type such as a cloth, etc.

In order to attain the above-described first and second objects, the present invention provides an image receiving sheet for receiving a desired image thereon, comprising: a support layer; and an absorbing layer provided on the support layer for absorbing and retaining therein color-forming material to thereby bear therein a desired image, the absorbing layer containing heat-meltable or thermoplastic particles. The absorbing layer serves to absorb and retain therein the color-forming material in such a manner that the color-forming material may be absorbed to be retained in spaces formed among the heat-meltable or thermoplastic particles.

In this description, the word "color-forming material" is defined as material capable of developing or presenting color.

In order to particularly attain the first object, according to the present invention, an image bearing product is produced from the image receiving sheet of the present invention, through the following image forming method of the present invention. The method for forming a desired image on the image receiving sheet includes the steps of: allowing the absorbing layer of the image receiving sheet to selectively absorb the color-forming material so that the absorbing layer may retain therein the desired visible image; and applying heat to the absorbing layer to change the heat-meltable or thermoplastic particles into a film shape.

The image forming method of the present invention may preferably include the steps of: forming a latent image on a surface of a photosensitive image recording medium; superposing the image receiving sheet on the photosensitive image recording medium in such a state that the latent image bearing surface of the photosensitive image recording medium is contacted face to face with the absorbing layer of the image receiving sheet and pressing the image receiving sheet and the photosensitive image recording medium toward each other so that a visible image corresponding to the latent image formed on the photosensitive image recording medium may be transferred onto the absorbing layer of the image receiving sheet; and applying heat to the image receiving sheet thus formed with the visible image in the absorbing layer so that the fine particles contained in the absorbing layer may be thermally melted or softened to be changed into a film shape.

According to the image forming method of the present invention, the latent image bearing surface of the photosensitive image recording medium is pressed toward the absorbing layer of the image receiving sheet, so that a visible image corresponding to the latent image formed on the photosensitive image recording medium is transferred onto the absorbing layer. Then, the image receiving sheet having the absorbing layer thus formed with the visible image is heated, so that the heat-meltable or thermoplastic particles bearing thereon the visible image are thermally melted or softened to form a film which bears the visible image thereon.

As a result, an image bearing product which includes the support layer of the image receiving sheet and the film formed on the support layer which bears therein the visible image is obtained. Since the image bearing product is thus covered with the film which is formed with the visible image, the image bearing product has a highly glossy and excellently transparent image-bearing surface.

In order to attain the above-described second object, the present invention provides a method for transferring a desired image on an article of an arbitrary type, the method comprising the steps of: preparing an image receiving sheet which includes a support layer and an absorbing layer provided on the support layer for absorbing and retaining therein color-forming material to thereby bear therein the desired image, the absorbing layer containing heat-meltable or thermoplastic particles; allowing the absorbing layer of the image receiving sheet to selectively absorb the color-forming material so that the absorbing layer may retain therein the desired visible image; superposing an article on the image receiving sheet with the desired visible image formed in the absorbing layer in such a manner that the absorbing layer may be contacted face to face with a surface of the article; thermally pressing the image receiving sheet toward the article so that the particles contained in the absorbing layer may be thermally melted or softened to be adhered onto the surface of the article; and removing the support layer of the image receiving sheet from the article, to thereby transfer the desired visible image formed on the image receiving sheet onto the surface of the article.

The image transferring method of the present invention may preferably include the steps of: forming a latent image on a surface of a photosensitive image recording medium; superposing the photosensitive image recording medium on an image receiving sheet which includes a support layer and an absorbing layer coated thereon which contains fine particles having a heat-meltable or thermoplastic property in such a state that the latent image bearing surface of the photosensitive image recording medium is contacted face to face with the absorbing layer of the image receiving sheet and pressing the image receiving sheet and the photosensitive image recording medium toward each other so that a visible image corresponding to the latent image formed on the photosensitive image recording medium may be transferred onto the absorbing layer of the image receiving sheet; and superposing the image receiving sheet thus formed with the visible image thereon on an article desired to be formed with the visible image in such a manner that the absorbing layer may be contacted face to face with a surface of the article and thermally pressing the image receiving sheet toward the article to thereby retransfer the visible image formed on the image receiving sheet onto the article.

According to the image transferring method of the present invention, the latent image bearing surface of the photosensitive image recording medium is pressed toward the absorbing layer of the image receiving sheet, so that a visible image corresponding to the latent image formed on the photosensitive image recording medium is transferred onto the absorbing layer. Then, the image receiving sheet provided with the absorbing layer which is formed with the visible image therein is superposed on an article desired to be formed with the visible image, in such a manner that the absorbing layer is contacted face to face relation with a surface of the article. The image receiving sheet is thermally pressed toward the article, so that the fine particles in the absorbing layer are melted or softened to be attached onto the surface of the article. In other words, the fine particles which bears thereon the visible image are melted or softened to be adhered onto the surface of the article. Thereafter, the support layer of the image receiving sheet is peeled off from the surface of the article, so that only the absorbing layer which retains the visible image thereon is retransferred onto the surface of the article. As a result, the visible image is retransferred onto the article from the image receiving sheet.

Other objects, features and advantages of the present invention will become apparent in the following specification and accompanying drawings.

BRIEF DESCRIPTION OF THE DRAWINGS

Throughout the accompanying drawings, the same or like reference numerals or characters refer to the same or like parts.

DETAILED DESCRIPTION OF PREFERRED EMBODIMENTS

Figure 4:
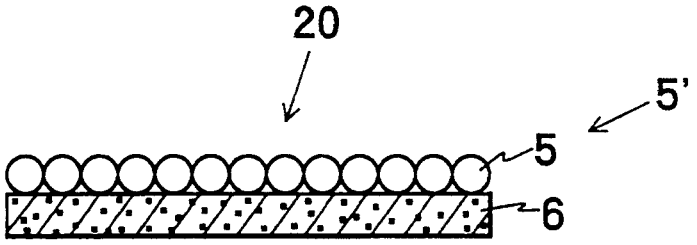
FIG. 4 illustrates an image receiving sheet of the present invention.

FIG. 4 shows an image receiving sheet 20 of the present invention which includes a support layer 6 and an absorbing layer 5' formed thereon which includes fine particles 5 having heat-meltable or thermoplastic property. The absorbing layer 5' serves to absorb therein materials such as color-forming materials which are flown out of microcapsules provided on a photosensitive image recording medium which will be described later, in such a manner that the materials may be absorbed into such spaces as defined among the fine particles 5.

Representative examples of the support layer 6 of the image receiving sheet 20 of the present invention include glass, paper, metal film, resin film such as polyethylene terephthalate, polyvinyl chloride, polyethylene, polypropylene, polystyrene and cellulose ester, paper laminated with resin material, etc.

Composition of the heat-meltable or thermo-plastic fine particles 5 for forming the absorbing layer 5' preferably has such a property that it is melted or softened at a temperature in a range from 50° to 200° C. to form a film. Representative examples of the composition of the fine particles 5 include: single substance such as polyethylene, polypropylene, polystyrene, polyvinyl acetate, polyvinyl chloride, polyethyl methacrylate, wax, etc.; copolymer such as ethylene-propylene copolymer, ethylene-vinyl-acetate copolymer, styrene-methacrylic acid ethylene copolymer, styrene-butadiene copolymer, styrene-acryl copolymer, ionomer, etc. The mean value of the particle diameter of the heat-meltable or thermoplastic fine particles 5 is equal to or larger than 0.1 micrometers, and more preferably is in a range from 0.5 to 20 micrometers.

In order to prepare coating liquid to be coated on the support layer 6 as the absorbing layer 5' including the heat-meltable or thermo-plastic fine particles 5, the fine particles 5 are added to a solvent. As the solvent, water is preferable. A small amount of binder such as starch, casein, polyvinyl alcohol, styrene-butadiene latex, etc. may also be added to the solvent of water. For example, the binder of an amount in a range from 5 to 15 parts by weight may be added to the solvent of water in which the heat-meltable or thermo-plastic fine particles 5 of an amount of 100 parts by weight are added. The coating amount of the coating liquid to be provided on the support layer 6 as the absorbing layer 5' is preferably in a range from 1 to 10 g/m$^2$.

Figure 5:
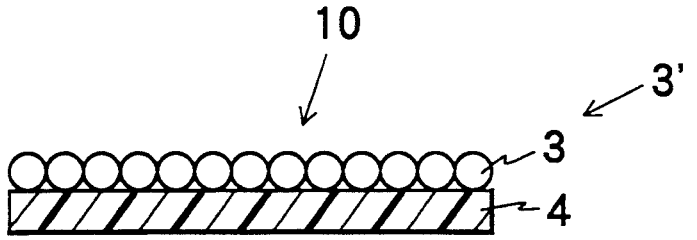
FIG. 5 illustrates a photosensitive image recording medium employed for transferring or forming a desired visible image on the image receiving sheet of the present invention.

According to the present invention, a desired image is transferred or formed on the image receiving sheet 20 of the present invention, with the use of a photosensitive image recording medium. As shown in FIG. 5, the photosensitive image recording medium 10 employed for transferring or forming a desired visible image on the image receiving sheet 20 has a base sheet 4 and a microcapsule layer 3' formed thereon. The microcapsule layer 3 includes a plurality of microcapsules 3 each of which changes its hardness through its exposure to light and each of which includes at least color-forming material. More specifically to say, each of the microcapsules 3 encapsulates therein material which changes its viscosity upon exposure to light and color-forming material such as dye or pigment which can present or develop color.

For example, the photosensitive image recording medium as disclosed in the already-described publication No. 61-275742 may be employed as the photosensitive image recording medium 10. The photosensitive image recording medium 10 of the publication includes the base sheet 4 and the microcapsule layer 3' provided thereon which includes a plurality of microcapsules 3 each of which encapsulates therein silver halide, reducing agent, polymerizable compound and color-forming material. In the photosensitive image recording medium 10, each microcapsule 3 has such a property that it will start being hardened upon exposure to light. The hardening action of the microcapsule 3 is remarkably promoted during when the photosensitive image recording medium 10 is entirely uniformly heated or is entirely uniformly exposed to light. Representative examples of the color-forming material encapsulated in the microcapsule 3 include: color-forming material of a type which presents color by itself such as dye or pigment; and color-forming material of another type which presents no color by itself but may develop color at the time when the microcapsule is applied with energy.

As preferred examples of the photosensitive image recording medium 10, a polyethylene terephthalate film, a sheet of art paper, etc. are used for the base sheet 4. As material for forming a wall of each microcapsule 3, urea formaldehyde-resorcinol resin, polyvinyl alcohol, etc. are preferably used. Silver iodide, silver bromide, etc. may be applicable as the silver halide. As the reducing agent, $\beta$ acetyl-p-aminophenyl hydrazine, etc. may be applicable. As the polymerizable compound, pentaerythritol triacrylate, trimethylolpropane triacrylate, etc. may be applicable. Carbon black, etc. may be applicable as the color-forming material.

A preferred example of the method for producing the photosensitive image recording medium 10 will be described below.

EXAMPLE OF THE METHOD FOR PRODUCING PHOTOSENSITIVE IMAGE RECORDING MEDIUM

First, photosensitive silver halide emulsion is prepared, in the following manner.

13 [g] of benzotriazole and 3 [g] of polyvinyl butyral are added to 100 [ml] of isopropyl alcohol so that the benzotriazole and the polyvinyl butyral may be dissolved in the isopropyl alcohol. Thus, solution A is prepared.

17 [g] of silver nitrate is added with water so that the silver nitrate may be dissolved in the water. Thus, 50 [ml] of solution B is prepared.

2.38 [g] of potassium bromide and 0.17 [g] of potassium iodide are added with water so that the potassium bromide and the potassium iodide may be dissolved in the water. Thus, 50 [ml] of solution C is prepared.

The solution A is poured into a reaction vessel. The solution A is fully agitated or stirred in the reaction vessel at a temperature of 40° C. during when the solution B is added to the solution A. The addition of the solution B to the solution A is continued for a period of time of 5 minutes. After when 5 minutes is passed from the time when the addition of the solution B to the solution A is completed, the solution C is added to the mixture of the solution A and the solution B. The addition of the solution C is continued for a period of time of 5 minutes. The agitation of the mixture of the solution A, B and C is further continued after when the addition of the solution is completed. The agitation of the mixture is stopped at the time when 5 minutes is passed from the time when the addition of the solution C is completed. The mixture of the solution A, B and C is then filtered, and is added with 200 [ml] of 20 [%] polyvinyl butyral in isopropyl. Thus prepared liquid is dispersed, with the use of a homogenizer. The dispersion is continued for a period of time of 20 minutes. As a result, photosensitive silver halide emulsion is prepared. In this case, yield amount of the emulsion is 250 [g].

Monomer mixture of 28 [g] of trimethylolpropane triacrylate and 7 [g] of methyl methacrylate is added with 6 [g] of dichloromethane. 2.1 [g] of carbon black is dispersed in the mixture. Then, the photosensitive silver halide emulsion prepared as described above is then added to the mixture, so that the mixture is changed into oil phase. Thus, mixture D in oil phase is obtained.

Mixture of 17.5 [g] of 10 [%] aqueous gum arabic solution, 18.8 [g] of 12 [%] aqueous isobutylene/maleic anhydride solution and 26.8 [g] of distilled water is subjected to pH adjustment with the use of sulfuric acid so that the mixture may present pH value of 3.5. Then, the mixture is added with 4.6 [g] of urea and 0.6 [g] of resorcinol. Thus, liquid E is obtained.

Then, the mixture D prepared as described above is dispersed in the liquid E so that emulsion in which the particles of the mixture D having diameter of 3 [μm] are dispersed in the liquid E is obtained. Then, 12.9 [g] of 36 [%] formalin is added to the emulsion, and the temperature of the emulsion is elevated to 60 [°C.] during when the emulsion is agitated. At the time when 1 [hour] is passed from the time when the temperature of the emulsion reaches 60 [°C.], 9.0 [g] of 5 [%] aqueous ammonium sulfate solution is added to the emulsion. While the temperature of the emulsion is maintained to 60 [°C.], the agitation of the emulsion is further continued for a period of time of 1 [hour]. Thereafter, the emulsion is cooled. The emulsion is then subjected to pH adjustment with the use of NaOH so that the emulsion may have pH value of 9.0. Thus, microcapsule liquid is obtained.

5 [g] of the microcapsule liquid is added with 1.53 [g] of 15 [%] aqueous polyvinyl alcohol solution, 3.47 [g] of distilled water and 0.57 [g] of starch, so that microcapsule coating liquid is obtained. The microcapsule coating liquid is coated, with the use of a coating rod, on a surface of a polyethylene terephthalate film. Then, the polyethylene terephthalate film thus coated with the microcapsule coating liquid is dried at a temperature of 50 [°C.] for a period of time of 15 minutes. As a result, the photosensitive image recording medium 10 shown in FIG. 5 is obtained.

As another example for the photosensitive image recording medium 10, an image recording medium as disclosed in Japanese Patent Unexamined Application Publication No. 62-39844 may be applicable. Each of the microcapsules provided on the image recording medium encapsulates therein photopolymerization initiator, the polymerizable compound and the color-forming material. The image recording medium is of such a type in which image formation is achieved during the light exposure and the pressure development processes.

A first embodiment of the present invention will be described hereinafter. According to the first embodiment, an image bearing product is produced from the image receiving sheet 20, in the following manner. In other words, a desired image is transferred or formed on the image receiving sheet so that an image bearing product bearing the desired image thereon is obtained.

Figure 1:
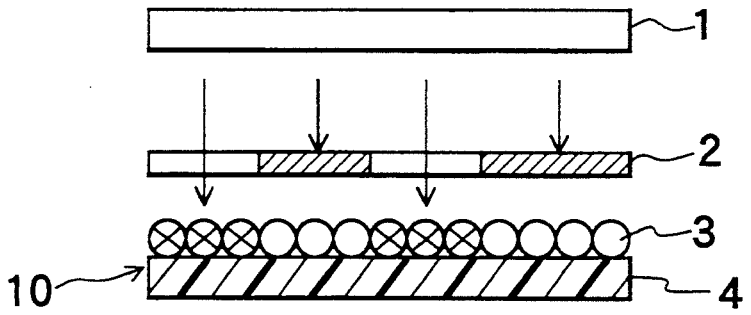
FIG. 1 illustrates the manner how the photosensitive image recording medium is exposed to imaging light so that a latent image is formed on the photosensitive image recording medium.

In order to transfer or form a desired image onto the image receiving sheet 20, the photosensitive image recording sheet 10 is first exposed to an imaging light corresponding to the desired image, to thereby selectively harden the microcapsules and form a desired latent image thereon, as shown in FIG. 1. More specifically to say, the photosensitive image recording medium 10 includes the base sheet 4 and the microcapsule layer 3' containing microcapsules 3 each of which encapsulates therein at least color-forming materials and each of which has a property that it is hardened upon exposure to light. Accordingly, upon exposure of the photosensitive image recording medium to the imaging light, the microcapsules which are exposed to the light are hardened, while the microcapsule which are not exposed to the light remains unhardened. Thus, a latent image corresponding to the desired image is formed on the photosensitive image recording medium.

Figure 2:
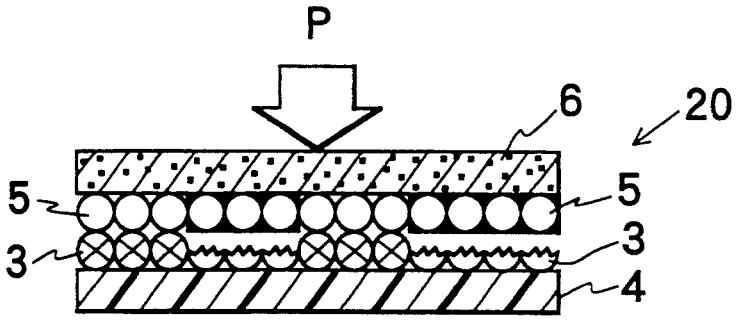
FIG. 2 illustrates the manner how the image receiving sheet is pressed toward the photosensitive image recording medium formed with the latent image.

Then, the image receiving sheet 20 is superposed on the photosensitive image recording medium 10 in such a state that the absorbing layer 5' is contacted in face to face relationship with the microcapsule layer 3'. As shown in FIG. 2, the image receiving sheet 20 and the photosensitive image recording medium 10 are then pressed toward each other, so that unhardened microcapsules which have not been exposed to the imaging light are ruptured so that the materials encapsulated in the ruptured microcapsules flow out therefrom and are absorbed into fine spaces defined among the fine particles 5 of the absorbing layer 5'. As a result, a visible image corresponding to the latent image is transferred onto the image receiving sheet 20. Thereafter, the image receiving sheet 20 is heated, so that the heat-meltable or thermoplastic fine particles 5 contained in the absorbing layer 5' are thermally melted or softened to form a film to thereby attain a highly glossy and excellently transparent surface formed with the desired visible image. As a result, there is obtained an image bearing product which includes the support layer 6 of the image receiving sheet 20 and the film which is formed from the heat-meltable or thermoplastic fine particles 5 and which bears thereon the visible image. Since the image-bearing surface of the image bearing product is thus covered with the film, the image bearing product can be used as an image printing product which has a highly glossy surface to attain a good appearance such as a silver halide photograph and can be used as an OHP sheet to be used in an overhead projector device which has a highly transparent surface to attain a high contrast.

Preferred examples of the method for producing the image receiving sheet 20 of the present invention and the method for producing the image bearing product from the image receiving sheet 20 will be described hereinafter.

Example 1

Styrene-acryl copolymer emulsion of 30 weight % (solid content) is prepared. The styrene-acryl copolymer emulsion has a mean value of particle diameter of 1.0 micrometer and has a softening point of 80° C. Aqueous solution of polyvinyl alcohol of 5 weight % having a saponification value of 97 is also prepared. The aqueous solution of polyvinyl alcohol of 30 parts by weight and the styrene-acryl copolymer emulsion of 100 parts by weight are added to each other, and are stirred or agitated so that a coating liquid is prepared. The coating liquid is coated, with the use of a bar coater, on a surface of a wood-free paper 6 which has a basis weight of 70 g/m$^2$ so that the coating amount of the coating liquid provided on the wood-free paper 6 is 7 g/m$^2$ in terms of solid content. The wood-free paper 6 coated with the coating liquid is then heated at temperature of 50° C. for 60 seconds so that the coating liquid is dried. As a result, the image receiving sheet 20 having the support layer 6 and the absorbing layer formed of the coating liquid is obtained, as shown in FIG. 4.

Then, a photosensitive image recording medium 10 which is obtained in the manner as described already in the EXAMPLE OF THE METHOD FOR PRODUCING PHOTOSENSITIVE IMAGE RECORDING MEDIUM is exposed to light through a mask member 2, as shown in FIG. 1. As a result, the microcapsules 3 exposed to the light start being hardened while the microcapsules 3 which are not exposed to the light remain unhardened. Thereafter, the photosensitive image recording sheet 10 is entirely heated uniformly, so that the hardening action of the microcapsules 3 which have been exposed to the light and which start to be hardened is remarkably promoted. Thus, the microcapsules 3 on the photosensitive image recording medium 10 are selectively hardened. In other words, a latent image corresponding to the mask member 2 is formed in the microcapsule layer 3'. The photosensitive image recording medium 10 thus formed with the latent image is superposed on the image receiving sheet 20 in such a manner that the microcapsule layer 3' is contacted face to face with the absorbing layer 5'. The photosensitive image recording medium and the image receiving sheet are then pressed toward each other at a pressure of 200 kg/cm$^2$. Unhardened microcapsules 3 which have not been exposed to the light are ruptured, and the material encapsulated in the unhardened microcapsules flow out of the ruptured microcapsules. The materials flown out of the ruptured microcapsules are attached onto the image receiving sheet 20, and are absorbed into spaces among the styrene-acryl copolymer particles 5 of the absorbing layer 5'. Since the materials flown out of the ruptured microcapsules include the color-forming material (carbon black, in this case), a visible image corresponding to the latent image is formed in the absorbing layer 5' of the image receiving sheet 20, as shown in FIG. 2. The image receiving sheet 20 thus formed with the visible image in the absorbing layer 5' is then heated at a temperature of 100° C. for 30 seconds, so that the styrene-acryl copolymer particles in the absorbing layer 5' are thermally melted to be changed into a film shape. Since thus formed film is glossy, the film-shaped absorbing layer 5' serves as a gloss surface. Thus, an image bearing product which has a high glossy surface having a gloss degree of 80 formed with the visible image is obtained.

Example 2

First, the image receiving sheet 20 is produced through the manner the same as described above in the Example 1, except that a polyethylene terephthalate film of thickness of 100 micrometers is used as the support layer 6, in place of the wood-free paper. As a result, the image receiving sheet 20 having the support layer 6 of polyethylene terephthalate film and the absorbing layer 5' as shown in FIG. 4 is obtained.

Then, similarly as in the Example 1, thus produced image receiving sheet 20 is superposed on the photosensitive image recording medium which has been formed with the latent image. The image receiving sheet 20 and the photosensitive image recording medium are pressed toward each other at a pressure of 200 kg/cm$^2$, so that the visible image is formed and transferred onto the image receiving sheet 20. Thereafter, the image receiving sheet thus formed with the visible image is heated at a temperature of 100° C. for 30 seconds, so that the styrene-acryl copolymer particles 5 in the absorbing layer 5' are thermally melted to be changed into a film shape. Since thus formed film is transparent, the film-shaped absorbing layer serves as a transparent surface of the image receiving sheet 20. Thus, an image bearing product which has a transparent surface having a haze degree of 7% formed with the visible image therein is obtained.

As apparent from the above, according to the present embodiment, the image receiving sheet 20 formed with the visible image is heated, so that the fine particles 5' provided in the absorbing layer 5 are melted or softened to form a film having a surface of high gloss and high transparency. In other words, according to the present embodiment, it is possible to adjust or control the gloss degree and the haze degree of the image bearing product through heat treatment. It is therefore possible to obtain an image bearing product formed with a desired image which has a highly glossy surface and which has an excellent transparent surface. Accordingly, it becomes possible to produce an image printing product which has a highly glossy surface of such a degree as similar to that of a silver halide photograph, and it becomes possible to produce an OHP sheet to be used for an overhead projector device which has an excellent transparent surface for attaining a high contrast image, even through an image forming method with the use of the photosensitive image recording medium 10.

The second embodiment of the present invention will be described hereinafter. According to the second embodiment, with the use of the image receiving sheet 20 of the present invention, a desired image is transferred or formed on an article of an arbitrary type having an arbitrary shape or size. In other words, the second embodiment directed to the method for transferring or forming a desired image on an article of an arbitrary type in which the desired image is first transferred onto the image receiving sheet and then the desired image thus transferred on the image receiving sheet is retransferred onto a surface of the article.

More specifically to say, similarly as in the first embodiment, the photosensitive image recording medium 10 is first exposed to an imaging light corresponding to an image desired to be formed on an article, as shown in FIG. 1. The photosensitive image recording medium 10 includes the base sheet 4 and the microcapsule layer 3' containing microcapsules 3 each of which encapsulates therein at least color-forming materials and each of which has a property that it is hardened upon exposure to light. Accordingly, upon exposure of the photosensitive image recording medium to the imaging light, the microcapsules which are exposed to the light are hardened, while the microcapsule which are not exposed to the light remains unhardened. Thus, a latent image corresponding to the desired image is formed on the photosensitive image recording medium.

Then, the photosensitive image recording medium 10 is superposed on the image receiving sheet 20 of the present invention which includes the support layer 6 and the absorbing layer 5' which contains the heat-meltable or thermoplastic particles 5, in such a manner that the microcapsule layer 3' is contacted face to face with the absorbing layer 5'. Then, the photosensitive image recording medium 10 is pressed toward the image receiving sheet 20, as shown in FIG. 2. As a result, the unhardened microcapsules are ruptured, and the color-forming materials flow out of the ruptured microcapsules and are absorbed into spaces defined among the particles 5 of the absorbing layer 5' to be retained therein. Then, the photosensitive image recording medium 10 is removed from the image receiving sheet. The absorbing layer 5' of the image receiving sheet remains retaining therein the color-forming materials, and therefore, the desired visible image is transferred onto the absorbing layer 5' of the image receiving sheet 20.

Figure 3:
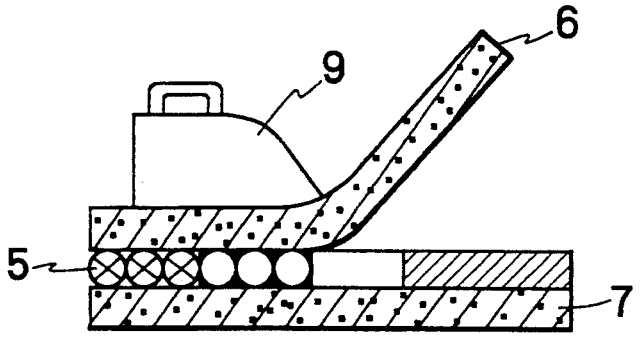
FIG. 3 illustrates the manner how the visible image retained on the image receiving sheet is retransferred onto a surface of an article such as a cloth.

Thereafter, the image receiving sheet 20 is superposed on the article 7 in such a manner that the absorbing layer 5' retaining the visible image therein is contacted face to face with a surface of the article. The image receiving sheet 20 is thermally pressed toward the surface of the article 7, as shown in FIG. 3. As a result, the fine particles 5 contained in the absorbing layer 5' are thermally melted or softened into a film form to be adhered onto the surface of the article 7. Then, the support layer 6 of the image receiving sheet 20 is removed from the article 7. Since the film formed with the visible image therein remains being adhered onto the surface of the article 7, the visible image is retransferred from the image receiving sheet onto the article surface, together with the film.

A preferred example of the method of the present embodiment for transferring a desired image on an article of arbitrary type will be described hereinafter.

EXAMPLE

Styrene-acryl copolymer emulsion of 30 weight % (solid content) is prepared. The styrene-acryl copolymer emulsion has a mean value of particle diameter of 1.0 micrometer and has a softening point of 80° C. Aqueous solution of polyvinyl alcohol of 5 weight % having a saponification value of 97 is also prepared. The aqueous solution of polyvinyl alcohol of 30 parts by weight and the styrene-acryl copolymer emulsion of 100 parts by weight are added to each other, and are stirred or agitated so that a coating liquid is prepared. The coating liquid is coated, with the use of a bar coater, on a surface of a wood-free paper 6 which has a basis weight of 80 g/m$^2$ and which has been subjected to water repellency treatment with silicone so that the coating amount of the coating liquid provided on the wood-free paper 6 is 7 g/m$^2$ in terms of solid content. Then, the wood-free paper 6 coated with the coating liquid is heated at temperature of 50° C. for 60 seconds so that the coating liquid is dried. As a result, the image receiving sheet 20 having the support layer 6 and the absorbing layer 5' formed of the coating liquid is obtained, as shown in FIG. 4.

Then, a photosensitive image recording medium 10 which is obtained in the manner as described already in the EXAMPLE OF THE METHOD FOR PRODUCING PHOTOSENSITIVE IMAGE RECORDING MEDIUM is exposed to light through a mask member 2, as shown in FIG. 1. As a result, the microcapsules 3 exposed to the light start being hardened while the microcapsules 3 which are not exposed to the light remain unhardened. Thereafter, the photosensitive image recording sheet 10 is entirely heated uniformly, so that the hardening action of the microcapsules 3 which have been exposed to the light and which start being hardened is remarkably promoted. Thus, the microcapsules 3 on the photosensitive image recording medium are selectively hardened. In other words, a latent image corresponding to the mask member 2 is formed in the microcapsule layer 3'.

The photosensitive image recording medium 10 thus formed with the latent image is superposed on the image receiving sheet 20 in such a manner that the microcapsule layer 3' is contacted face to face with the absorbing layer 5'. The photosensitive image recording medium 10 and the image receiving sheet 20 are then pressed toward each other at a pressure of 200 kg/cm$^2$. Unhardened microcapsules 3 which have not been exposed to the light are ruptured, and the materials encapsulated in the unhardened microcapsules flow out of the ruptured microcapsules. The materials flown out of the microcapsules are attached onto the image receiving sheet 20 to be absorbed in spaces among the particles 5 of the absorbing layer 5', as a result of which a visible image corresponding to the latent image is formed in the absorbing layer 5' of the image receiving sheet 20, as shown in FIG. 2.

Then, the image receiving sheet 20 thus formed with the visible image is superposed on a cloth 7 (cotton broad #200) in such a manner that the absorbing layer 5' of the image receiving sheet 20 formed with the image therein is contacted in face to face relationship with the cloth 7. Then, the image receiving sheet 20 and the cloth 7 are thermally pressed toward each other with the use of an iron 9 at a temperature of 120° C. for 15 seconds. As a result, the fine particles 5 of styrene-acryl copolymer in the absorbing layer 5' are thermally melted to be adhered onto a surface of the cloth 7. In other words, the fine particles 5 of styrene-acryl copolymer of the absorbing layer 5' which carry thereon the visible image is transferred from the wood-free paper 6 of the image receiving sheet 20 onto the cloth 7. As a result, the visible image is retransferred onto the surface of the cloth 7. The wood-free paper 6 is then removed from the cloth 7, and the cloth 7 formed with the visible image thereon is obtained.

As described above, according to the image transferring method of the present embodiment, it is possible to transfer a desired image onto any kind of article having any shape or size. Accordingly, it is possible to easily transfer a desired image onto cloths or the like.

While the present invention has been described in detail and with reference to specific embodiments thereof, it will be apparent to one skilled in the art that various changes and modifications can be made therein without departing from the spirit and scope thereof.

What is claimed is:

1. A method for forming a desired image on a support layer, comprising the steps of:

preparing an image receiving sheet which includes a support layer and an absorbing layer provided on the support layer, the absorbing layer including solid heat-meltable or thermoplastic particles so as to absorb and retain color-forming material in spaces defined exterior to and among the heat-meltable or thermoplastic particles, the heat-meltable or thermoplastic material forming a film when heated to a temperature between the range of 50° C. to 200° C. to melt or soften the thermoplastic particles, and said heat-meltable or thermoplastic material being selected from the group consisting of polyethylene, polypropylene, polystyrene, polyvinyl acetate, polyvinyl chloride, polyethyl methacrylate, wax, ethylene-propylene copolymer, ethylene-vinyl-acetate copolymer, styrene-methacrylic acid ethylene copolymer, styrene-butadiene copolymer, styrene-acryl copolymer, and ionomer, allowing the absorbing layer of the image receiving sheet to selectively absorb the color-forming material into said spaces defined exterior to and among the heat-meltable or thermoplastic particles so that the color-forming material may be distributed in the absorbing layer to form a desired visible image; and heating the absorbing layer to change the heat-meltable or thermoplastic particles among which the color-forming material is retained into a film shape in which the color-forming material is distributed to form the desired visible image.

2. The image forming method as claimed in claim 1, including the steps of:

preparing an image recording medium which includes a base sheet and a microcapsule layer provided on the base sheet, the microcapsule layer including microcapsules each of which encapsulates therein the color-forming material and each of which is selectively hardened in correspondence with the desired image;

superposing the image recording medium on the image receiving sheet in such a state that the microcapsule layer of the image recording medium is contacted face to face with the absorbing layer of the image receiving sheet; and pressing the image receiving sheet and the image recording medium toward each other so that unhardened microcapsules may be ruptured to allow the color-forming material encapsulated therein to flow out therefrom to be absorbed into spaces among the heat-meltable or thermoplastic particles in the absorbing layer of the image receiving sheet.

3. The image forming method as claimed in claim 1, wherein said color-forming material absorbing step includes the steps of:

preparing a photosensitive image recording medium having a latent image on a surface thereof;

superposing the photosensitive image recording medium on the image receiving sheet in such a state that the latent image bearing surface of the photosensitive image recording medium is contacted face to face with the absorbing layer of the image receiving sheet; and pressing the image receiving sheet and the photosensitive image recording medium toward each other so that a visible image corresponding to the latent image formed on the photosensitive image recording medium may be transferred into the absorbing layer of the image receiving sheet.

4. The image forming method as claimed in claim 3, wherein the photosensitive image recording medium preparing step includes the step of exposing the surface of the photosensitive image recording medium to a desired image bearing light to form thereon the latent image corresponding to the desired image.

5. The image forming method as claimed in claim 4 wherein the photosensitive image recording medium includes a base sheet and a microcapsule layer provided on the base sheet, the microcapsule layer including microcapsules each of which encapsulates therein the color-forming material and each of which is hardened upon its exposure to light, and wherein said color-forming material absorbing step includes the steps of:

exposing the microcapsule layer of the photosensitive image recording medium to a desired image bearing light so as to selectively harden the microcapsules in the microcapsule layer in correspondence with the desired image, unhardened microcapsules being distributed to form a latent image which also corresponds to the desired image;

superposing the photosensitive image recording medium on the image receiving sheet in such a state that the microcapsule layer of the photosensitive image recording medium is contacted face to face with the absorbing layer of the image receiving sheet; and pressing the image receiving sheet and the photosensitive image recording medium toward each other to rupture unhardened microcapsules to allow the color-forming material encapsulated therein to flow out therefrom to be absorbed in spaces among the heat-meltable or thermoplastic particles in the absorbing layer of the image receiving sheet so that a visible image corresponding to the latent image formed on the photosensitive image recording medium may be transferred into the absorbing layer of the image receiving sheet.

6. A method for transferring a desired image on an article of an arbitrary type, comprising the steps of;

preparing an image receiving sheet which includes a support layer and an absorbing layer provided on the support layer, the absorbing layer including solid heat-meltable or thermoplastic particles so as to absorb and retain color-forming material in spaces defined exterior to and among the heat-meltable or thermoplastic particles to thereby bear a desired image in the absorbing layer, the heat-meltable or thermoplastic material forming a film when heated to a temperature between the range of 50° C. to 200° C. to melt or soften the thermoplastic particles, and said heat-meltable or thermoplastic material being selected from the group consisting of polyethylene, polypropylene, polystyrene, polyvinyl acetate, polyvinyl chloride, polyethyl methacrylate, wax, ethylene-propylene copolymer, ethylene-vinyl-acetate copolymer, styrene-methacrylic acid ethylene copolymer, styrene-butadiene copolymer, styrene-acryl copolymer, and ionomer, allowing the absorbing layer of the image receiving sheet to selectively absorb the color-forming material into spaces among the heat-meltable or thermoplastic particles so that the color-forming material may be retained in the spaces among the heat-meltable or thermoplastic particles to be distributed in the absorbing layer to form the desired visible image therein;

superposing said article of arbitrary type on the image receiving sheet in which the color-forming material is retained among the heat-meltable or thermoplastic particles in the absorbing layer in such a manner that the absorbing layer is contacted face to face with a surface of the article;

thermally pressing the image receiving sheet toward the article so that the heat-meltable or thermoplastic particles of the absorbing layer among which the color-forming material is retained may be thermally melted or softened into a film in which the color-forming material is retained to be distributed to form the desired visible image, the film with the color-forming material thus retained therein adhering to the surface of the article; and removing the support layer of the image receiving sheet from the film adhered to the surface of the article, to thereby transfer the desired visible image formed on the image receiving sheet onto the surface of the article.

7. The image forming method as claimed in claim 6, wherein said color-forming material absorbing step includes the steps of:

preparing image recording medium which includes a base sheet and a microcapsule layer provided on the base sheet, the microcapsule layer including microcapsules each of which encapsulates therein the color-forming material and each of which is selectively hardened in correspondence with the desired image;

superposing the image recording medium on the image receiving sheet in such a state that the microcapsule layer of the image recording medium is contacted face to face with the absorbing layer of the image receiving sheet; and pressing the image receiving sheet and the image recording medium toward each other so that unhardened microcapsules may be ruptured to allow the color-forming material encapsulated therein to flow out therefrom to be absorbed in the spaces among the heat-meltable or thermoplastic particles in the absorbing layer of the image receiving sheet.

8. The image forming method as claimed in claim 6, wherein said color-forming material absorbing step includes the steps of:

preparing a photosensitive image recording medium having a latent image on a surface thereof;

superposing the photosensitive image recording medium on the image receiving sheet in such a state that the latent image bearing surface of the photosensitive image recording medium is contacted face to face with the absorbing layer of the image receiving sheet; and pressing the image receiving sheet and the photosensitive image recording medium toward each other so that a visible image corresponding to the latent image formed on the photosensitive image recording medium may be transferred into the absorbing layer of the image receiving sheet.

9. The image forming method as claimed in claim 8, wherein the photosensitive image recording medium preparing step includes the step of exposing the surface of the photosensitive image recording medium to a desired image bearing light to form thereon the latent image corresponding to the desired image.

10. The image forming method as claimed in claim 9, wherein the photosensitive image recording medium includes a base sheet and a microcapsule layer provided on the base sheet, the microcapsule layer including microcapsules each of which encapsulates therein the color-forming material and each of which is hardened upon its exposure to light, and wherein said color-forming material absorbing step includes the steps of:

exposing the microcapsule layer of the photosensitive image recording medium to a desired image bearing light so as to selectively harden the microcapsules in the microcapsule layer in correspondence with the desired image, unhardened microcapsules being distributed to form a latent image which also corresponds to the desired image;

superposing the photosensitive image recording medium on the image receiving sheet in such a state that the microcapsule layer of the photosensitive image recording medium is contacted face to face with the absorbing layer of the image receiving sheet; and pressing the image receiving sheet and the photosensitive image recording medium toward each other to rupture unhardened microcapsules to allow the color-forming material encapsulated therein to flow out therefrom to be absorbed in spaces among the heat-meltable or thermoplastic particles in the absorbing layer of the image receiving sheet so that a visible image corresponding to the latent image formed on the photosensitive image recording medium may be transferred into the absorbing layer of the image receiving sheet.

* * * * *